US007067013B2

(12) United States Patent
Theoleyre et al.

(10) Patent No.: US 7,067,013 B2
(45) Date of Patent: Jun. 27, 2006

(54) METHOD AND PLANT FOR THE PRODUCTION OF REFINED SUGAR FROM A SUGARED JUICE

(75) Inventors: Marc-André Theoleyre, Paris (FR); Stanislas Baudouin, Aubergenville (FR)

(73) Assignee: APPLEXION (GB)

( * ) Notice: Subject to any disclaimer, the term of this patent is extended or adjusted under 35 U.S.C. 154(b) by 0 days.

(21) Appl. No.: 10/413,617

(22) Filed: Apr. 14, 2003

(65) Prior Publication Data

US 2003/0230301 A1 Dec. 18, 2003

(30) Foreign Application Priority Data

Apr. 17, 2002 (FR) ..... 02 04794

(51) Int. Cl.

| | |
|---|---|
| ***C13J 1/06*** | (2006.01) |
| ***B01J 3/00*** | (2006.01) |
| ***C13D 3/00*** | (2006.01) |
| ***B01D 9/00*** | (2006.01) |
| ***C13F 1/02*** | (2006.01) |

(52) U.S. Cl. ..... 127/46.2; 127/2; 127/9; 127/15; 127/16; 127/55; 127/58; 127/61; 127/62

(58) Field of Classification Search ..... 127/2, 127/9, 15, 16, 46.2, 55, 58, 61, 62
See application file for complete search history.

(56) References Cited

U.S. PATENT DOCUMENTS

| | | | | |
|---|---|---|---|---|
| 5,554,227 | A * | 9/1996 | Kwok et al. | 127/58 |
| 5,865,899 | A * | 2/1999 | Theoleyre et al. | 127/42 |
| 5,902,409 | A * | 5/1999 | Kwok et al. | 127/58 |
| 6,440,222 | B1 * | 8/2002 | Donovan et al. | 127/55 |
| 6,485,574 | B1 * | 11/2002 | Chou et al. | 127/46.2 |

* cited by examiner

*Primary Examiner*—J. A. Lorengo
*Assistant Examiner*—Patricia L. Hailey
(74) *Attorney, Agent, or Firm*—Gerald E. Hespos; Anthony J. Casella

(57) ABSTRACT

Method for producing refined sugar from sugared juice, such as raw juice from sugar cane or from sugar beet, containing sugar and impurities, which comprises the operations of:

Figure 1:
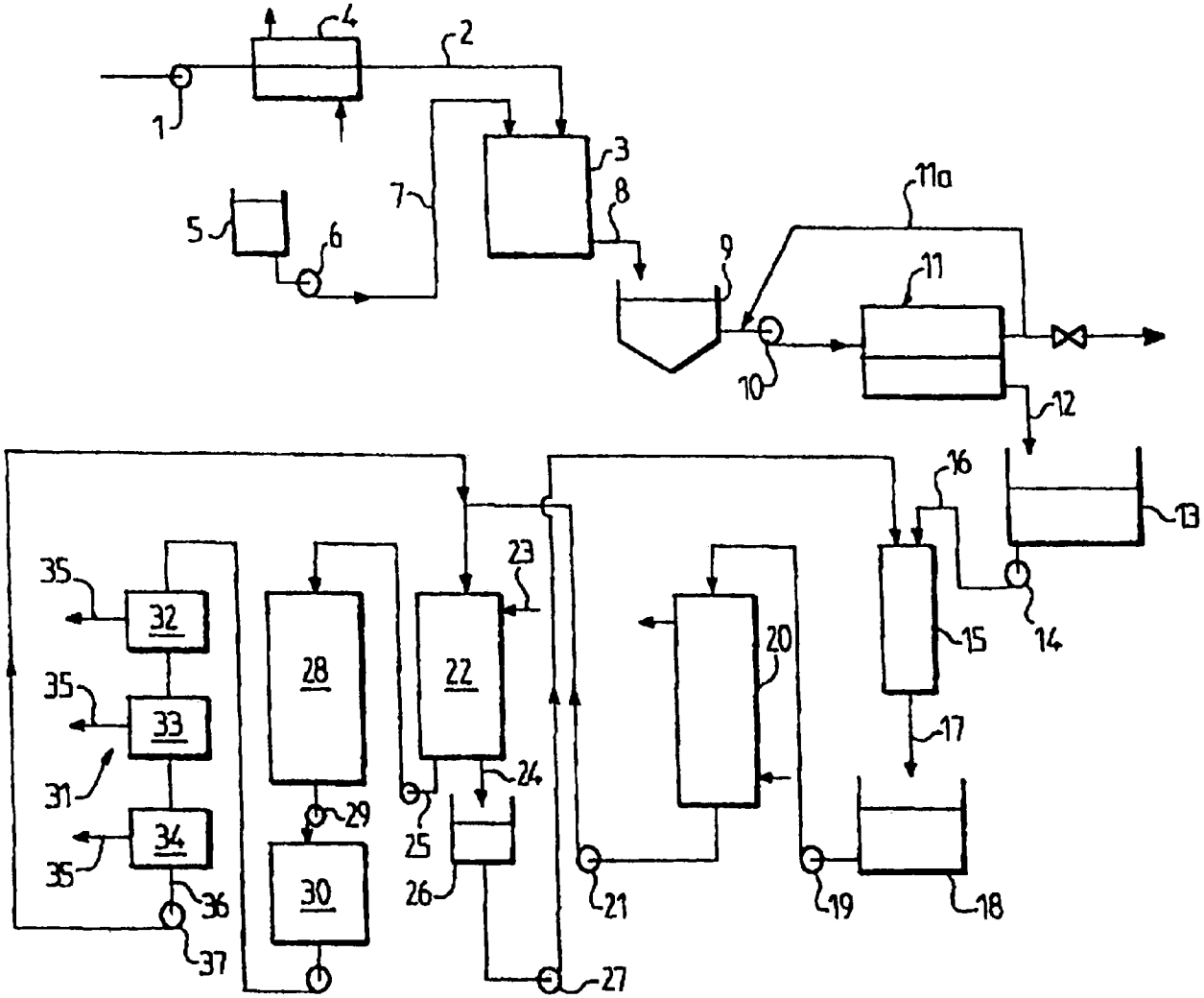

tangential filtration of the sugared juice in order to obtain a retentate and a filtrate, softening of the filtrate in order to obtain a softened filtrate, concentration of the softened filtrate in order to obtain a softened syrup, chromatography of the softened syrup in order to obtain an extract enriched in sugars and a raffinate enriched in impurities, crystallisation of the extract in two or more crystallisation/separation steps in order to obtain refined sugar and a run-off, and combination of the run-off with the softened syrup in order that they are both subjected to the chromatography operation.

12 Claims, 1 Drawing Sheet

METHOD AND PLANT FOR THE PRODUCTION OF REFINED SUGAR FROM A SUGARED JUICE

The subject of the present invention is a method for producing refined sugar from sugared juice, such as a raw juice from sugar cane or from sugar beet; the subject is likewise a plant for implementing the method.

At present, the production of refined sugar (or white sugar) from sugar cane comprises a certain number of treatments implemented in a sugar mill, followed by a certain number of supplementary treatments implemented in a refinery.

Schematically, the principal treatment steps in the sugar mill are the extraction of the sugar by crushing—pressing of the cane or by diffusion which leads to a raw sugared juice, the clarification of this juice by addition of lime, neutralisation of the latter by carbon dioxide (in the case of sugar beet) and decantation of the thus treated juice, the concentration of the resulting juice and finally the crystallisation and spinning of the sugar generally in three steps, which leads to raw sugar and molasses being obtained.

In the refinery, the operations to which the raw sugar is subjected are essentially a fining (washing of the crystals with a saturated aqueous sugar solution then spinning) in order to eliminate the impurities situated on the surface of the crystals, re-dissolving of the resulting sugar, a clarification, a decolouration, a crystallisation and a spinning. Because of the relatively high purity of the syrup which is subjected to this crystallisation, the latter operation is more difficult than in the sugar mill and requires two to three crystallisation/separation steps, the purity of the run-off from the last crystallisation/separation step is still very high and the sugar which it contains is extracted by a complementary crystallisation of 3 or 4 steps, termed crystallisation "of low grade sugars", which leads to the production of a very coloured sugar, which is recycled at the head of the refinery, and of molasses. It will be noted that because of the high viscosity of the product subjected to this crystallisation, the latter is costly in material and in energy.

For several years, a certain number of methods have been studied in order to improve the quality of the sugar at the level of the sugar mill.

Thus, Kwock et al. proposed, in the U.S. Pat. No. 5,554,227, a method leading to the production of a raw sugar with low colouration termed SVLC "Super Very Low Colour" by linking the operations of filtration over a membrane, of softening and of crystallisation. This method permits a simplification of the refining of the raw sugar and in particular the elimination of the operations of fining and purification. It permits likewise the implementation of a chromatography step in order to recover the sugar from the molasses and thus to improve the extraction yield of the sugar mill. This chromatography generally leads to the production of two fractions, i.e. an extract rich in sugar and a raffinate containing the impurities from the sugar.

McKearny et al. proposed for their part, in the international application WO 95/16 794, chromatography as a means of purification of the juices from sugar beet after their clarification, softening and concentration and before crystallisation. This document shows that, starting from a syrup with a purity (percentage by weight of sugar with respect to the dry material) of approximately 90%, chromatography permits this purity to be raised to at least 94%. The crystallisation of such a syrup in three crystallisation/separation steps gives a white sugar and molasses with a purity of approximately 60%.

However, the application of this method to sugar cane juice is inconceivable from an economic point of view.

In fact the production of white sugar from sugar cane juice requires starting from a syrup having a purity which is much higher than that of a sugar beet syrup, i.e. of the order of 98% instead of 94%. In these conditions, it becomes impossible to produce white sugar with a good yield by means of a crystallisation with 3 crystallisation/separation steps because, in order to preserve the quality of the produced sugar, it is not possible to crystallise more than 50 to 60% of the sugar present, at each crystallisation/separation step.

One solution to this problem would be to prolong the crystallisation by 2 or 3 crystallisation/separation steps termed depletion steps, which comes to reproducing crystallisation of low grade products implemented in the refinery, and the avoidance of which is precisely what is being sought.

The object of the present invention is therefore to resolve the aforementioned problem in an economical manner and in order to do this a production method for refined sugar (or white sugar) is proposed starting from a sugared juice, such as raw juice from sugar cane or from sugar beet, containing sugars and impurities, this method being characterised in that it comprises the operations of:

- tangential filtration of the sugared juice in order to obtain a retentate and a filtrate,
- softening of the filtrate in order to obtain a softened filtrate,
- concentration of the softened filtrate in order to obtain a softened syrup,
- chromatography of the softened syrup in order to obtain an extract enriched in sugars and a raffinate enriched in impurities,
- crystallisation of the extract in two or more crystallisation/separation steps in order to obtain refined sugar and a run-off, and
- combination of the run-off with the softened syrup in order that they are both subjected to the chromatography operation.

Thus, in accordance with the present invention there is no prolongation of the crystallisation, but recycling of the run-off from the last crystallisation/separation step in order to subject it to the chromatography operation conjointly with the syrup derived from the concentration operation.

There is therefore no longer production of molasses, the non-sugars (impurities) from the sugared juice being eliminated in the raffinate fraction of the chromatography and the sugar from the last run-off being recovered in the extract fraction of said chromatography, which increases the global yield.

Advantageously, the method according to the invention comprises furthermore a clarification operation of the sugared juice before it is subjected to the tangential filtration operation; this clarification eliminates the non-dissolved materials.

In addition, the tangential filtration operation will preferably be selected from a tangential ultrafiltration, a tangential microfiltration and a tangential nanofiltration; these filtration techniques, which use appropriate membranes, are well known in the prior art.

The softening operation comprises preferably an ion exchange operation, having recourse to an ion (cation) exchange resin, for example in the form of $Na^+$.

It will be noted that before the extract formed in the course of the chromatography operation is subjected to the crystallisation operation, it is subjected to a concentration operation.

The method according to the invention can furthermore comprise a decolouration operation of the extract, preferably of the concentrated extract, before it is subjected to the crystallisation operation; this decolouration can comprise treatment of the extract by an absorbent resin.

It should be mentioned that according to the invention there is advantageously provided a regeneration operation of the ion exchange resin used in the softening operation, by means of the raffinate produced during the chromatography operation.

The subject of the present invention is furthermore a plant for implementing the aforementioned method, this plant being characterised in that it comprises:

a source of sugared juice, means for the tangential filtration of the sugared juice issued from this source, these means including a filtrate outlet, means for softening the filtrate, including a softened filtrate outlet, means for the concentration of the softened filtrate, including a syrup outlet, means for chromatographying said syrup, including a raffinate outlet and an extract outlet, means for the concentration of the extract, including a concentrated extract outlet, means for the crystallisation, in two or more than two crystallisation/separation steps, of the concentrated extract, including means for recovering the crystallised sugar and means for recovering the run-off from the last crystallisation/separation step of crystallisation, and means for supplying this run-off at the head of the chromatography means.

The aforementioned plant can furthermore comprise means for the decolouration of the concentrated extract issued from the concentrated extract outlet of the concentration means.

Finally, the softening means advantageously comprise an ion exchange resin, means for supplying the raffinate at the head of the softening means being then provided with a view to the regeneration of said resin.

One embodiment of the present invention is described hereafter with reference to the attached single FIGURE which is a schematic representation of the plant according to the invention.

The starting material used in this method is raw sugar cane juice, for example obtained by crushing—pressing of the sugar canes, which leads to a fibrous residue (bagasse) and a raw juice; as a variation, recourse can be had to the diffusion technique comprising depleting the sugar canes, cut into fragments, by hot water, which leads to a residue and to a raw juice. It goes without saying that the raw starting juice could likewise be a raw juice from sugar beet.

The aforementioned raw juice, which contains sugars and non-sugars is possibly subjected to a clarification.

The object of this clarification is to eliminate the major portion of the solid materials in suspension. For this purpose, the raw juice is supplied by the feed pump 1 and the pipe 2 to the high portion of a flocculation reservoir 3, after having been heated preferably to 70–105° C., for example by means of an indirect heat exchanger 4. In this reservoir 3, it is mixed under brisk agitation with a suspension of dead lime stored in the reservoir 5 and supplied from the latter to the high portion of the reservoir 3 by a feed pump 6 and a pipe 7. A cationic, anionic or non-ionic surface-active flocculating agent, such as Separan® from the DEGREMONT company, is then introduced into the limed juice. Normally, the dosage of lime will be from 0.5 to 4 g/l of juice and the quantity of flocculating agent will be from 1 to 10 mg/kg of dry material of the juice to be treated. The limed juice supplemented by the flocculating agent is then supplied by a pipe 8 into a settling tank 9.

Although it is not represented in the single FIGURE, the bottom of the tank 9 can be provided with a pipe and with an extraction pump supplying the solid sediment collected in the conical portion of the tank 9 into a filtration unit (for example a rotary filter), the filtrate then being redirected into the tank 9. After a contact time of the order of 30 to 120 minutes between the raw sugared juice and the flocculating agent, the supernatant (clarified juice) in the tank 9 is extracted from the latter by a feed pump 10 discharging into a tangential microfiltration, tangential ultrafiltration or tangential nanofiltration unit 11. If necessary, the supernatant thus drawn off from the tank 9 can be heated in order that the operation in this unit II takes place at a temperature of the order of 70 to 99° C. and preferably of 95 to 99° C. The membrane used in the unit 11 can be of the organic type or of the mineral type (for example made of $TiO_2$ or $ZrO_2$) and can have a cutoff threshold corresponding to a molecular weight of at least 1,000, good results being obtained with an ultrafiltration membrane having a cutoff threshold corresponding to a molecular weight of 300,000, and with a microfiltration membrane having a pore diameter of 0.1 μm. Thus, use can be made for example of the KERASEP® membrane available from the French company TECHSEP® or of the FIMTEC® GR 90 PP membrane from the Americain company DOW. The rate of tangential circulation of the clarified juice is adapted to the geometry of the micro ultra- or nanofiltration module which is used and will be of the order of 2 to 9 m/s, preferably 6 m/s. This circulation rate is controlled by the pump 10, it being specified that one portion of the filtered juice is redirected by a return pipe 11*a* to the suction of said pump 10.

The filtrate (permeate) derived from the unit 11 is then directed by a pipe 12 into a storage reservoir 13 from which it is drawn off by a pump 14 in order to be supplied at the head of a softening column 15 which is filled with a cation exchange resin, in particular a strong cationic resin, in the form $Na^+$ and/or $K^+$, for example a resin from Rhom and Haas. This column is provided, at its upper portion, with a filtrate supply 16 connected to the delivery of the pump 14 and, at its lower portion, to an outlet pipe 17 for softened filtrate (content of $Ca^{2+}$ and/or $Mg^{2+}$ ions of the order of 10 to 50 ppm), the $Ca^{2+}$ and/or $Mg^{2+}$ ions present in the filtrate supplied at the head of the column (content of $Ca^{2+}$ and/or $Mg^{2+}$ ions of the order of 300 to 3,000 ppm) being retained by the resin in the course of the progression of the filtrate through the column whilst displacing the $Na^+$ and/or $K^+$ ions of this resin.

The softened filtrate removed by the pipe 17 then passes into a reservoir 18, from where it is drawn off by a pump 19 in order to be supplied into a concentration unit 20 which can for example be an evaporator such as a falling flow evaporator. The syrup obtained as output of this unit 20 is then supplied by a pump 21 into a chromatography unit 22. This unit can be of the column type comprising a fixed support formed by a strong cationic resin, in the form $Na^+$ and/or $K^+$, for example the resin DOWEX® C356 of the DOW company, the elution liquid being water supplied at the upper portion of the column by a pipe 23. This same column 22 is provided on its lower portion with a removal pipe 24 for a first liquid effluent (raffinate) depleted in sugars, enriched in Na and/or K salts and eluted first of all and with a removal pipe 25 for a second liquid effluent (extract) enriched in sugars, depleted in Na and/or K salts and eluted in second place. Said raffinate derived from the pipe 24 is received in a storage vessel 26. Because of its high content of $Na^+$ and/or $K^+$ ions, said raffinate can advantageously be used as regeneration liquid for the softening column 15. For this purpose, the raffinate received in the storage vessel 26 is supplied via a pump 27 at the head of the softening column 15. The circuit 26–27 will be brought into service when it is desired to regenerate the resin filling the column 15, said raffinate serving as regeneration liquid because of its high content of $Na^+$ and/or $K^+$. With this aim in view, it will suffice to stop the pump 14, to start the pump 27 and to divert the effluent discharging from the pipe 17 towards a reservoir other than the reservoir 18.

As regards the extract derived from the pipe 25, it is supplied into a concentration unit 28 which can for example be of the same type as the aforementioned concentration unit 20.

It will be noted that the chromatography unit 22 can as a variant be of the type with a sequential simulated moving bed.

If desired, the concentrated extract obtained at the outlet of the unit 28 is then supplied by a pump 29 into a decolouration unit 30 which can comprise a column packed with an absorbent material such as bone charcoal, activated charcoal or a decolouration resin, for example a strong anionic resin in the form of chloride, such as IRA 900® resin from Rohm and Haas. In this column 30, the decolouration is preferably achieved with heat, for example at 80° C. The type and the quantity of the absorbent material will be chosen in order to obtain a white crystallised sugar.

The thus decoloured extract is then supplied into a crystallisation unit 31 with several crystallisation/separation stages, three crystallisation/separation stages in the illustrated plant.

More precisely, this unit 31 comprises three crystallisation stages 32, 33, 34 corresponding respectively to the three aforementioned crystallisation/separation stages. At each of these stages, crystallised sugar is formed which is separated from the run-off by spinning. The crystallised sugar is removed by appropriate removal means given the reference 35 overall.

In addition, the run-off from the third crystallisation/separation stage removed from stage 34 by the pipe 36 is supplied via a feed pump 37 at a point situated between the pump 21 and the chromatography unit 22, so as to be mixed with the syrup derived from the concentration unit 20; a storage vessel for run-off (not shown) is possibly present in the circuit supplying the run-off in question from the stage 34 to the chromatography unit 22.

In accordance with the present invention, the purity in saccharose (expressed by the percentage of saccharose with respect to the dry material) and the degree of colouration (expressed in ICUMSA units) of the different effluents formed in the course of the method implemented in the aforementioned plant are as follows:

| | Dry material (%) | Purity in saccharose (%) | Colouration (ICUMSA) |
|---|---|---|---|
| Clarified juice | 100 | 90.0 | 10,000 |
| Syrup (derived from the concentration unit 20) | 100 | 90.0 | 10,000 |
| Liquid supplied at the head of the chromatography unit (mixture of syrup + run-off) | 114 | 89.7 | 10,000 |

-continued

| | Dry material (%) | Purity in saccharose (%) | Colouration (ICUMSA) |
|---|---|---|---|
| Extract | 102 | 98.2 | 2,000 |
| Raffinate | 12 | 17.0 | — |
| Run-off (derived from stage 34) | 14 | 87.8 | 10,000 |
| Crystal sugar | 88 | 100.0 | ≦200 |

The preceding FIGUREs show that the method and the plant according to the invention permit a crystallised sugar of high quality to be obtained; in fact, instead of a standard colour of the order of 1000 ICUMSA, there is produced according to the invention a sugar with less than 200 ICUMSA, even less than 100 ICUMSA by increasing the rate for clearing sugar, it being specified that it is even possible to obtain a sugar of very low colour (<50 ICUMSA) if the decolouration is implemented in the unit 30.

In addition, with respect to a conventional sugar mill, the method according to the invention permits an extraction yield of the sugar calculated at the entry to the crystallisation workshop which goes from 88% to over 96%.

The invention claimed is:

1. Method for producing refined sugar from sugared juice, such as raw juice from sugar cane or from sugar beet, containing sugar and impurities, which comprises the operations of:

tangential filtration of the sugared juice in order to obtain a retentate and a filtrate, softening of the filtrate in order to obtain a softened filtrate, concentration of the softened filtrate in order to obtain a softened syrup, chromatography of the softened syrup in order to obtain an extract enriched in sugars and a raffinate enriched in impurities, and crystallisation of the extract in two or more crystallisation/separation steps in order to obtain refined sugar and a run-off, characterised in that it comprises furthermore the operation of:

combination of the run-off with the softened syrup in order that they are both subjected to the chromatography operation.

2. Method according to claim 1, characterised in that it comprises furthermore a clarification operation of the sugared juice before it is subjected to the tangential filtration operation.

3. Method according to claim 1, characterised in that the tangential filtration operation is selected from a tangential ultrafiltration, a tangential microfiltration and a tangential nanofiltration.

4. Method according to claim 1, characterised in that the softening operation comprises an ion exchange operation, having recourse to an ion exchange resin.

5. Method according to claim 4, characterised in that it comprises furthermore a regeneration operation of the ion exchange resin used in the softening operation, by means of the raffinate produced during the chromatography operation.

6. Method according to claim 1, characterised in that it comprises furthermore a concentration operation of the extract before it is subjected to the crystallisation operation, in order to obtain a concentrated extract.

7. Method according to claim 1, characterised in that it comprises furthermore a decolouration operation of the extract before it is subjected to the crystallisation operation.

8. Method according to claim 7, characterised in that the decolouration operation comprises the treatment of said extract by an absorbent resin.

9. Method according to claim 7, characterised in that the decolouration operation is effected on the concentrated extract.

10. Plant for implementing the method of claim 1, characterised in that it comprises:

a source of sugared juice, means for tangential filtration of the juice derived from this source, these means including a filtrate outlet, means for softening the filtrate, including a softened filtrate outlet, means for the concentration of the softened filtrate, including a syrup outlet, means for the chromatography of the syrup, including a raffinate outlet and an extract outlet, means for the concentration of the extract, including a concentrated extract outlet, means for the crystallisation, in two or more than two crystallisation/separation steps, of the concentrated extract, including means for recovering crystallised sugar and means for recovering the run-off from the last crystallisation/separation step of crystallisation, and means for supplying this run-off at the head of the chromatography means.

11. Plant according to claim 10, characterised in that it comprises furthermore means for the decolouration of the concentrated extract derived from the concentrated extract outlet of the concentration means.

12. Plant according to claim 10, characterised in that the softening means comprise an ion exchange resin and in that it comprises furthermore means for supplying the raffinate at the head of the softening means with a view to the regeneration of said resin.

* * * * *

UNITED STATES PATENT AND TRADEMARK OFFICE

CERTIFICATE OF CORRECTION

PATENT NO. : 7,067,013 B2
APPLICATION NO. : 10/413617
DATED : June 27, 2006
INVENTOR(S) : Marc-Andre Theoleyre and Stanislas Baudouin It is certified that error appears in the above-identified patent and that said Letters Patent is hereby corrected as shown below:

Title Page, item [73] Assignee: should read --APPLEXION (FR)--

Signed and Sealed this

Seventh Day of November, 2006

JON W. DUDAS
*Director of the United States Patent and Trademark Office*